US009370858B2

(12) United States Patent
Lefavour et al.

(10) Patent No.: US 9,370,858 B2
(45) **Date of Patent: *Jun. 21, 2016**

(54) BUCKET TRUCK INTENSIFIER HAVING A HYDRAULIC MANIFOLD

(71) Applicant: Hubbell Incorporated, Shelton, CT (US)

(72) Inventors: John D. Lefavour, Litchfield, NH (US); Thomas R. Faucher, Manchester, NH (US); William L. Benedict, Littleton, NH (US); Henry A. Maxwell, Pembroke, NH (US); James Del Bonis, Southborough, MA (US)

(73) Assignee: Hubbell Incorporated, Shelton, CT (US)

( * ) Notice: Subject to any disclaimer, the term of this patent is extended or adjusted under 35 U.S.C. 154(b) by 116 days.

This patent is subject to a terminal disclaimer.

(21) Appl. No.: 13/925,600

(22) Filed: Jun. 24, 2013

(65) Prior Publication Data

US 2013/0340237 A1 Dec. 26, 2013

Related U.S. Application Data

(60) Provisional application No. 61/663,830, filed on Jun. 25, 2012.

(51) Int. Cl.
*B25B 21/00* (2006.01)
*B25B 27/10* (2006.01)

(52) U.S. Cl.
CPC ..... *B25B 21/001* (2013.01); *B25B 27/10* (2013.01); *Y10T 29/49913* (2015.01); *Y10T 29/49917* (2015.01); *Y10T 29/49927* (2015.01); *Y10T 29/53726* (2015.01)

(58) Field of Classification Search
CPC ..... H01R 43/042; H01R 43/0427; H01R 43/0428; H01R 43/048; B23D 17/06; B23D 17/08; B25B 27/00; B25B 27/14; B25B 27/10; B25B 28/00; Y10T 29/53222; Y10T 29/53226; Y10T 29/53235; Y10T 29/53726; Y10T 29/53039; Y10T 29/53065; Y10T 29/49917; Y10T 29/49913
See application file for complete search history.

(56) References Cited

U.S. PATENT DOCUMENTS

| | | | | |
|---|---|---|---|---|
| 3,070,143 | A * | 12/1962 | Klingler | 72/19.9 |
| 4,151,720 | A * | 5/1979 | Vanderstappen | 60/479 |
| 4,342,216 | A | 8/1982 | Gregory | |
| 4,366,673 | A * | 1/1983 | Lapp | 60/477 |
| 4,671,063 | A * | 6/1987 | Anaker | 60/458 |

(Continued)

FOREIGN PATENT DOCUMENTS

JP 2008113513 5/2008

*Primary Examiner* — Essama Omgba
(74) *Attorney, Agent, or Firm* — Michael Best & Friedrich, LLP

(57) ABSTRACT

A high pressure tool assembly includes a tool and a hand control valve connected to the tool. A hydraulic manifold is fluidly connected to the hand control valve. An intensifier is fluidly connected to the hydraulic manifold and to the tool. The intensifier increases the pressure of a first operating fluid supplied to the tool. A first fluid circuit is formed between the hand control valve, the hydraulic manifold and the intensifier. The first fluid circuit operates at a first pressure. A second fluid circuit is formed between the intensifier and the tool and operates at a second pressure. The second pressure is larger than the first pressure. The second fluid circuit is isolated from the first fluid circuit.

20 Claims, 10 Drawing Sheets

(56) References Cited

U.S. PATENT DOCUMENTS

| | | | | | |
|---|---|---|---|---|---|
| 5,113,679 | A * | 5/1992 | Ferraro et al. | ..... | 72/21.1 |
| 5,152,162 | A * | 10/1992 | Ferraro et al. | ..... | 72/16.8 |
| 5,195,042 | A * | 3/1993 | Ferraro et al. | ..... | 700/117 |
| 5,979,215 | A | 11/1999 | LeFavour | | |
| 6,148,507 | A | 11/2000 | Swanson | | |
| 6,490,962 | B1 | 12/2002 | Schultz | | |
| 6,990,888 | B2 | 1/2006 | Harwath | | |
| 7,686,596 | B2 | 3/2010 | Clausen | | |
| 9,205,541 | B2 * | 12/2015 | Lefavour | ..... | B25B 21/001 |
| 2005/0005672 | A1 | 1/2005 | Sneath | | |
| 2005/0178121 | A1 * | 8/2005 | Hansen et al. | ..... | 60/560 |
| 2013/0340223 | A1 * | 12/2013 | Lefavour et al. | ..... | 29/243.519 |
| 2015/0288125 | A1 * | 10/2015 | Sneath | ..... | F16K 15/042 60/428 |

* cited by examiner

BUCKET TRUCK INTENSIFIER HAVING A HYDRAULIC MANIFOLD

CROSS REFERENCE TO RELATED APPLICATION

This application claims the benefit under 35 U.S.C. §119 (e) of U.S. Provisional Application Ser. No. 61/663,830, filed Jun. 25, 2012, which is hereby incorporated by reference in its entirety. This application contains subject matter related to co-pending U.S. patent application Ser. No. (to be assigned), entitled "Bucket Truck Intensifier," filed Jun. 24, 2013.

FIELD OF THE INVENTION

The present invention relates to a lightweight, high pressure tool assembly. More particularly, the present invention relates to a high pressure tool assembly operable from a bucket truck. Still more particularly, the present invention relates to a high pressure tool assembly including an intensifier for increasing pressure of an operating fluid, a hand control valve connected to a tool for controlling operation thereof, and a hydraulic manifold connected to the intensifier and the hand control valve to control to control operation of the intensifier responsive to the hand control valve.

BACKGROUND OF THE INVENTION

There is a growing demand for lighter weight, ergonomic utility tools, such as crimping and cutting tools, to reduce operator injury. Of particular interest is the need for lighter weight tools that are used by utility workers. Much of the work performed by utility workers is performed while standing within the bucket of a bucket truck. The nature of the work often requires the workers to hold a crimp tool in position on an electrical connector with their arms extended. The utility tools are generally heavy and awkward to operate. With rising concerns regarding preventing personal injury while operating such equipment, ergonomics are an important consideration. The weight of the utility tool becomes critical, as does the crimp cycle times.

Crimping and cutting tool designs vary in size, weight and configuration. Although most utility tools are high pressure (10,000 psi), low pressure (1500-3000 psi) utility tools are also used when working from the bucket of the bucket truck.

Low pressure crimp tools can be heavy and very unbalanced. However, in most cases, low pressure crimp tools crimp quickly. These low pressure crimp tools are typically powered by a hydraulic pump source, such as directly from the bucket truck. Low pressure operated crimp tools traditionally incorporate a large piston that is subjected to 1500-3000 psi operating pressure. The disadvantage of these tools is that they are heavy, big and not well balanced. From an ergonomic point of view, they score very low.

High pressure crimp tools are relatively light weight and ergonomic, however, they crimp slowly. These tools may also require gripping in an area of high pressure, which can be dangerous if there is a failure.

High pressure crimp tools are usually operated with an intensifier or a booster pump, which is powered by a bucket truck circuit. The booster or intensifier operates on low pressure and increases or intensifies the output to the 10,000 psi operating pressure requirement for high pressure tools. The booster pump may incorporate a hydraulic motor, such as gerotor or gear motor type, which can drive a high pressure pump to deliver 10,000 psi oil to a remote crimp head via a hydraulic hose. These units tend to be very slow during the high pressure delivery cycle as a result of low volumetric flow rates. There are also intensifiers that have reciprocating pistons that incorporate shuttle spools to sequence the pistons. These units are slow and have many moving parts.

Accordingly, a need exists for an improved high pressure tool that is easily handled and operates quickly.

SUMMARY OF THE INVENTION

Accordingly, it is a primary objective of the present invention to provide a high pressure tool that is lightweight and easy to operate.

A further objective of the present invention is to provide a high pressure tool that operates quickly.

Another objective of the present invention is to provide an improved intensifier for a high pressure tool.

Another objective of the present invention is to provide an improved hydraulic manifold for an intensifier for a high pressure tool.

The foregoing objectives are basically attained by a high pressure tool assembly including a tool and a hand control valve connected to the tool. A hydraulic manifold is fluidly connected to the hand control valve. An intensifier is fluidly connected to the hydraulic manifold and to the tool. The intensifier increases the pressure of an operating fluid supplied to the tool. A first fluid circuit is formed between the hand control valve, the hydraulic manifold and the intensifier. The first fluid circuit operates at a first pressure. A second fluid circuit is formed between the intensifier and the tool. The second fluid circuit operates at a second pressure. The second pressure is larger than the first pressure. The second fluid circuit is isolated from the first fluid circuit.

The foregoing objectives are also basically attained by a method of operating a high pressure tool. A hand control valve sends a signal to a hydraulic manifold. A first operating fluid is supplied from the hydraulic manifold to a first connection of an intensifier responsive to the received signal. A second operating fluid is pressurized to a high pressure with a piston assembly of the intensifier responsive to the operating fluid received by the first connection. The high pressure second operating fluid is supplied to the tool.

Other objects, advantages and salient features of the invention will become apparent from the following detailed description, which, taken in conjunction with the annexed drawings, discloses exemplary embodiments of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF AN EXEMPLARY EMBODIMENT

The exemplary embodiment of the present invention provides a quick-operating and lightweight tool that is easily handled and operated. The following description is directly to a high pressure crimping tool, although the present invention is equally applicable to any high pressure tool, such as a cutting tool.

Figure 1:
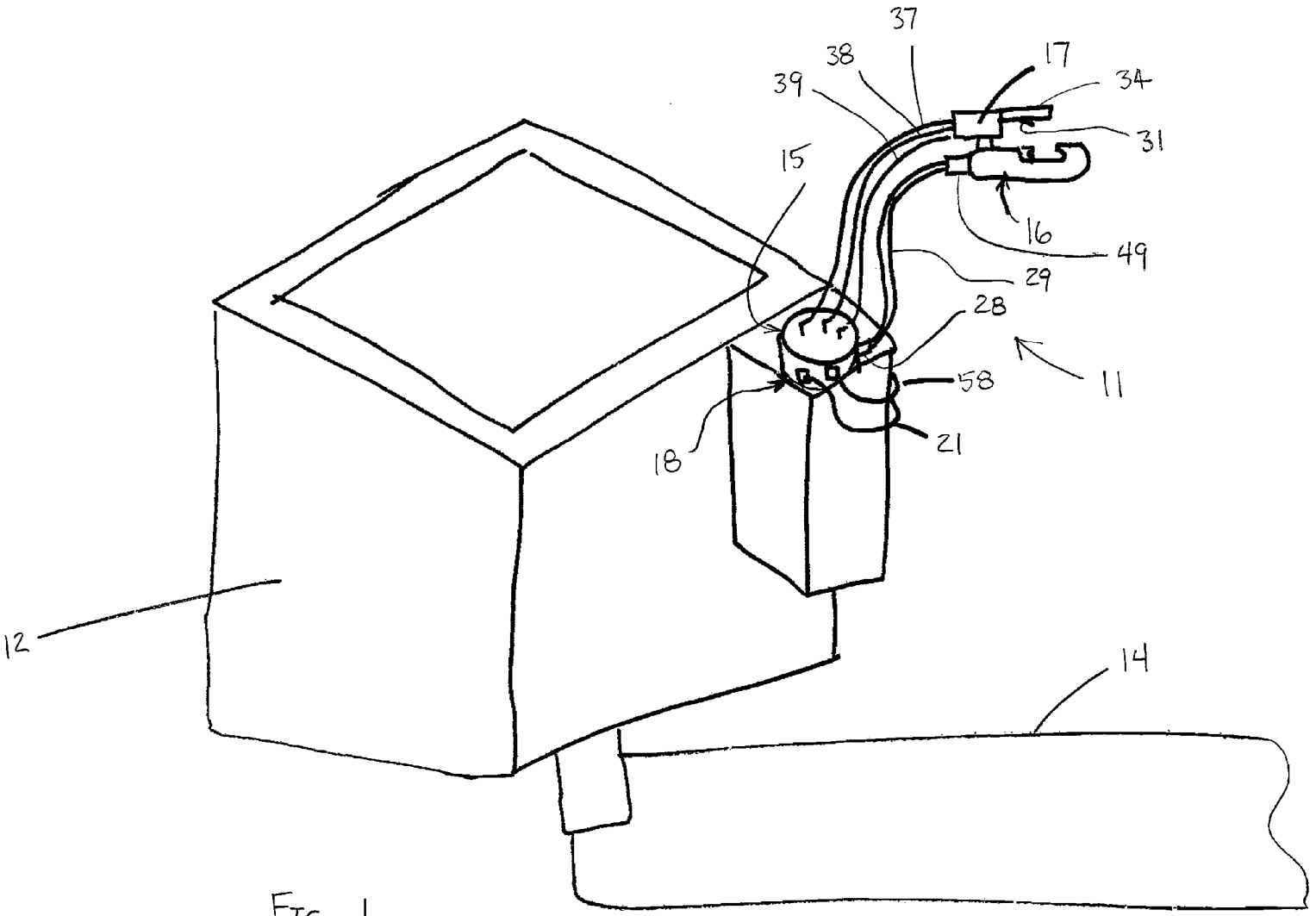
FIG. 1 is a perspective view of a bucket truck assembly according to an exemplary embodiment of the present invention.
Figure 11:
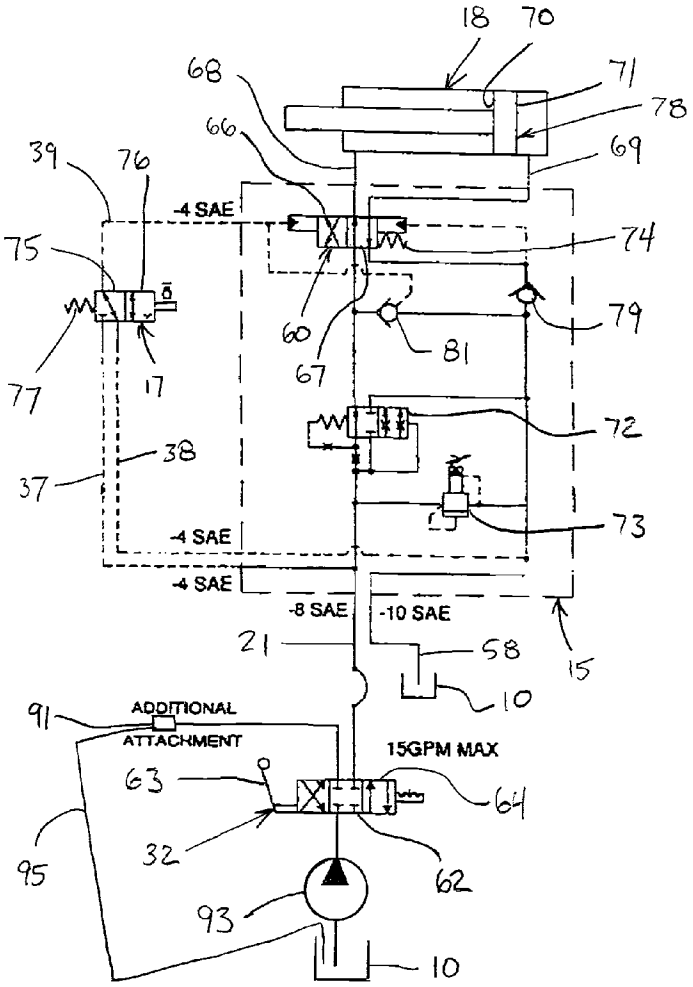
FIG. 11 is a schematic diagram of the hydraulic circuit of FIG. 8 with an additional tool connected thereto.
Figure 10:
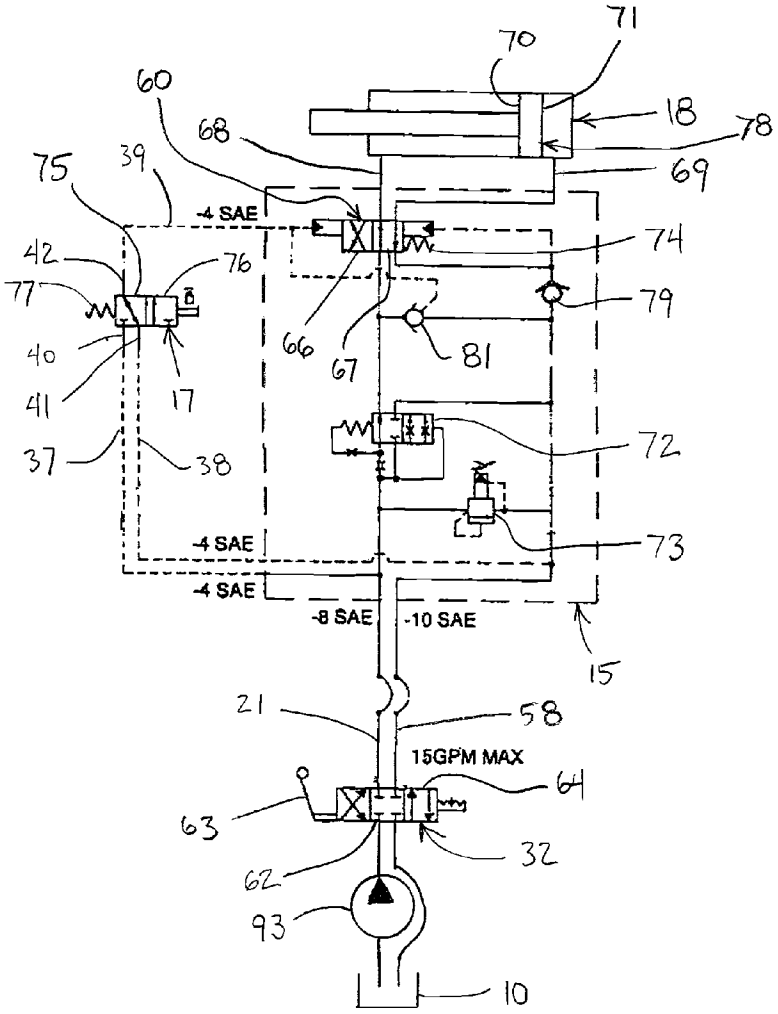
FIG. 10 is a schematic diagram of a hydraulic circuit.

The exemplary embodiments of the present invention include a bucket truck tool assembly 11 operable by a user from a bucket truck 12, as shown in FIG. 1. A boom 14 connects the bucket 12 to a truck. The boom 14 is extendable to lift a utility worker in the bucket 12 to a position to perform the necessary work. A bucket truck valve 32, as shown in FIGS. 10 and 11, is connected to the bucket truck 12 (FIG. 1) to control the supply of operating fluid from a truck reservoir 10 on the truck to the components of the bucket truck tool assembly 11. Preferably, the operating fluid is hydraulic oil, although any suitable operating fluid can be used.

Figure 2:
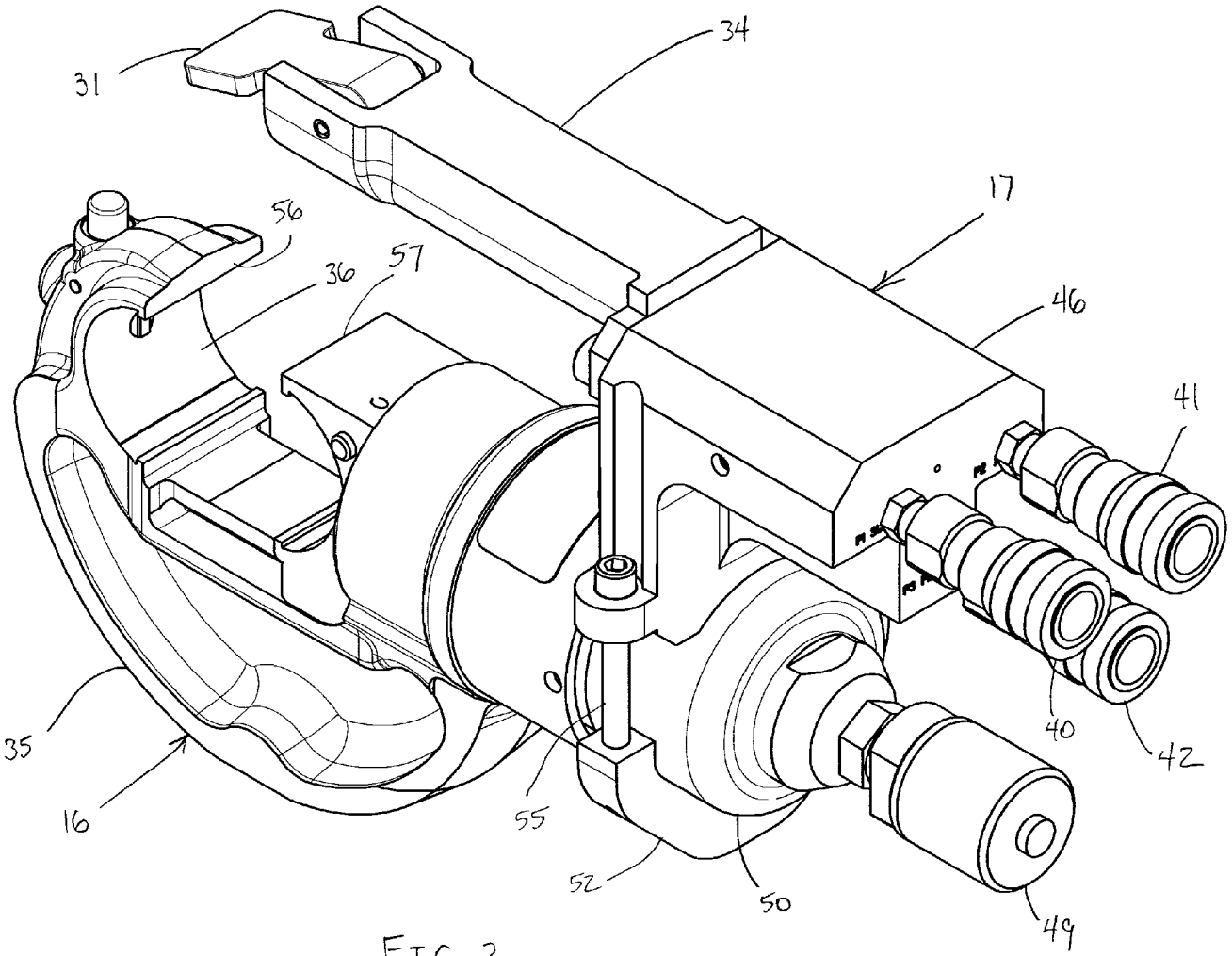
FIG. 2 is a perspective view of a tool and hand control valve of FIG. 1.
Figure 3:
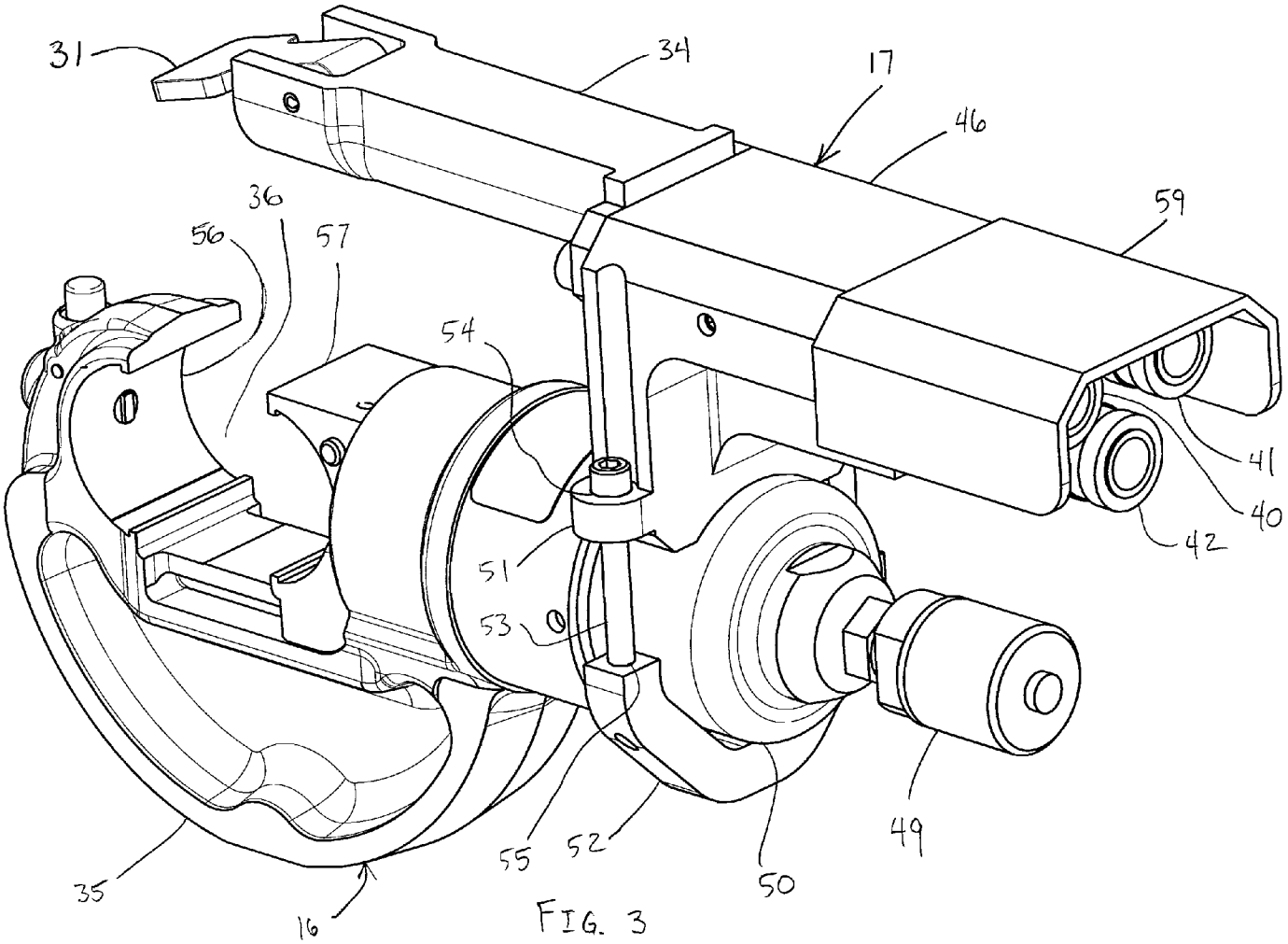
FIG. 3 is a perspective view of a guard connected to the hand control valve of FIG. 2.

The bucket truck tool assembly 11 includes a hand control valve 17, an intensifier 18 and a hydraulic manifold 15 for operating a high pressure crimping tool 16, as shown in FIGS. 1-11. The intensifier 18 intensifies or increases the pressure of the operating fluid supplied to the tool 16 to the required high pressure. The remote crimping tool 16 is lightweight and operates at a high pressure, such as approximately 10,000 psi. The hand control valve 17 is mounted directly to the remote crimping tool 16. The hand control valve 17 is positioned to enable the operator to have a handle 34 or gripping region proximal the center of gravity of the remote crimping tool 16, as shown in FIGS. 2 and 3. The hand control valve handle 34 is disposed opposite the tool head 35. The work area 36 is disposed between the handle control valve handle 34 and the tool head 35. The hand control valve 17 is lightweight, preferably about approximately three pounds. The hand control valve 17 is preferably operated at a low pressure, such as approximately 1500 psi. Accordingly, the user does not need to handle the tool 16 to which the high pressure oil is supplied. The user can support and operate the tool 16 through the hand control valve 17, thereby substantially preventing injury associated with operating high pressure tools.

A first fluid circuit is formed between the hand control valve 17, the hydraulic manifold 15 and the intensifier 18, as shown in FIGS. 1, 10 and 11. The hand control valve 17, the hydraulic manifold 15 and the intensifier 18 are fluidly connected to allow for a first operating fluid to be conveyed therebetween. The first fluid circuit operates at a first pressure. Preferably, the first pressure is a low pressure, such as approximately 1500 psi. A second fluid circuit is formed between the intensifier 18 and the tool 16, as shown in FIG. 1. The second fluid circuit operates at a second pressure and is isolated from the first fluid circuit. The second pressure is larger than the first pressure. Preferably, the second pressure is a high pressure, such as approximately 10,000 psi. Preferably, the first and second fluid circuits are hydraulic circuits.

A plurality of pilot lines 37, 38 and 39 are connected to the hand control valve 17, as shown in FIGS. 1, 10 and 11. First, second and third pilot connections 40, 41 and 42 are connected to a housing 46 of the pilot control valve 17, as shown in FIGS. 2 and 3, receive the first, second and third pilot lines 37, 38 and 39, respectively. First, second and third pilot openings 43, 44 and 45 in the housing 46, as shown in FIGS. 4-7, allow for the passage of operating fluid, such as hydraulic oil, in and out of hand control valve 17. The pilot lines 37, 38 and 39 extend between the hand control valve 17 and the hydraulic manifold 15, as shown in FIGS. 1, 10 and 11, to control operation of the tool 16. An activating lever or trigger 31 is connected to the handle 34 of the hand control valve 17 to control operation thereof.

Figure 8:
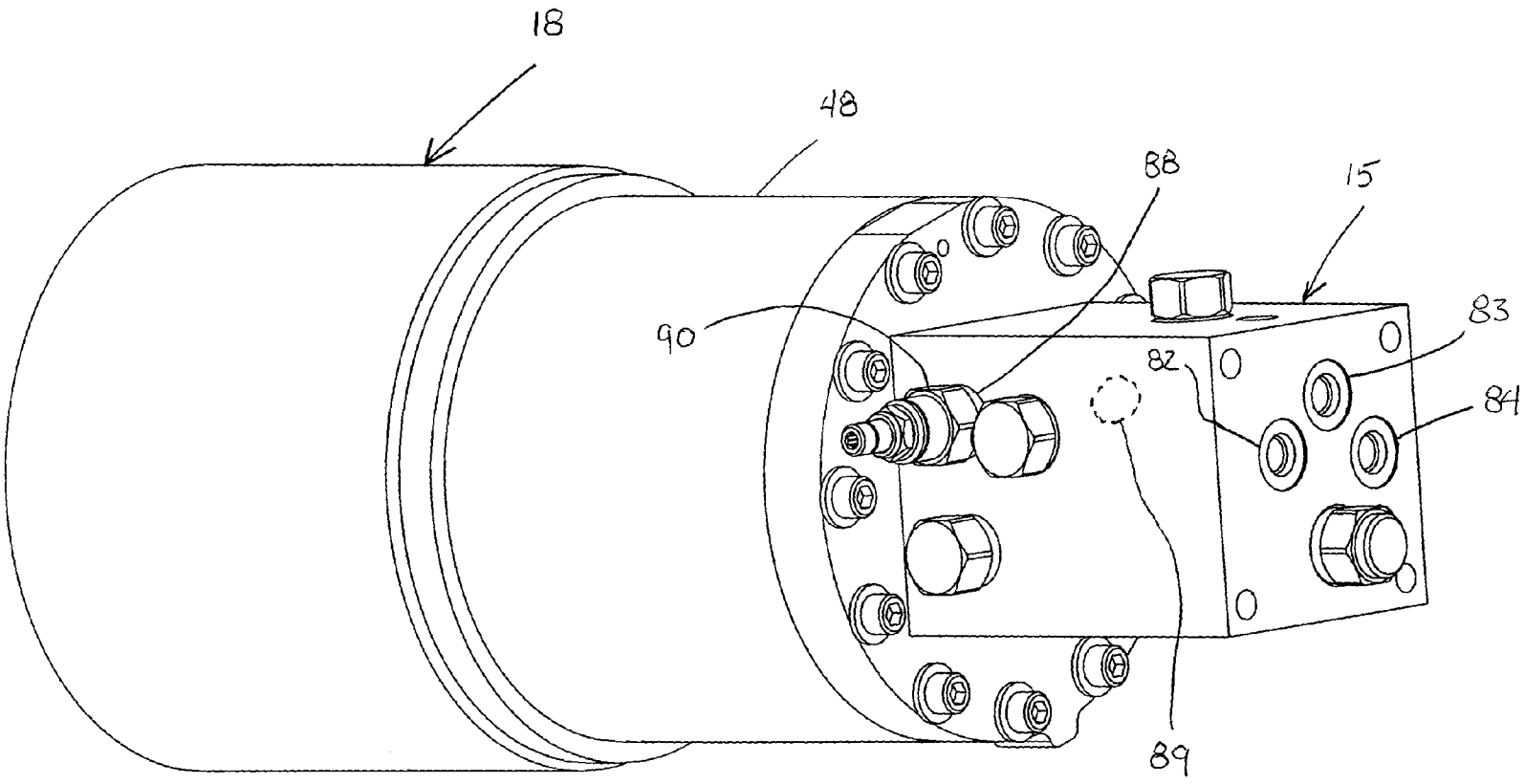
FIG. 8 is a side perspective view of the intensifier of FIG. 1.

Operating fluid, such as hydraulic oil, is supplied between the intensifier 18 and an oil reservoir 10 on the truck, as shown in FIGS. 1, 10 and 11. A supply line or hose 21 supplies oil from the truck pump 93 to the intensifier 18. A return line or hose 58 returns oil from the intensifier 18 to the oil reservoir 10 in the truck. The supply hose 21 has an inlet connector 90 connected to an inlet opening 88 in the hydraulic manifold 15, as shown in FIG. 8, to supply operating fluid through the inlet opening 88 in the hydraulic manifold 15 to the intensifier 18 through the bucket truck valve 32 and through the directional control valve 60 in the hydraulic manifold 15, as shown in FIGS. 10 and 11. The return hose 58 is connected to an outlet connector connected to an outlet opening 89 in the hydraulic manifold 15, as shown in FIG. 8, to return operating fluid from the intensifier 18 to the truck reservoir 10, as shown in FIGS. 10 and 11. The outlet opening 89 is preferably disposed on the opposite side of the hydraulic manifold 15 as the inlet opening 88, as shown in FIG. 8.

A guard 59 is connected to the hand control valve housing 46, as shown in FIG. 3, to substantially cover the pilot line connections 40, 41 and 42 to substantially prevent injury to the user in the event of a leak or accidental line disconnect.

Figure 9:
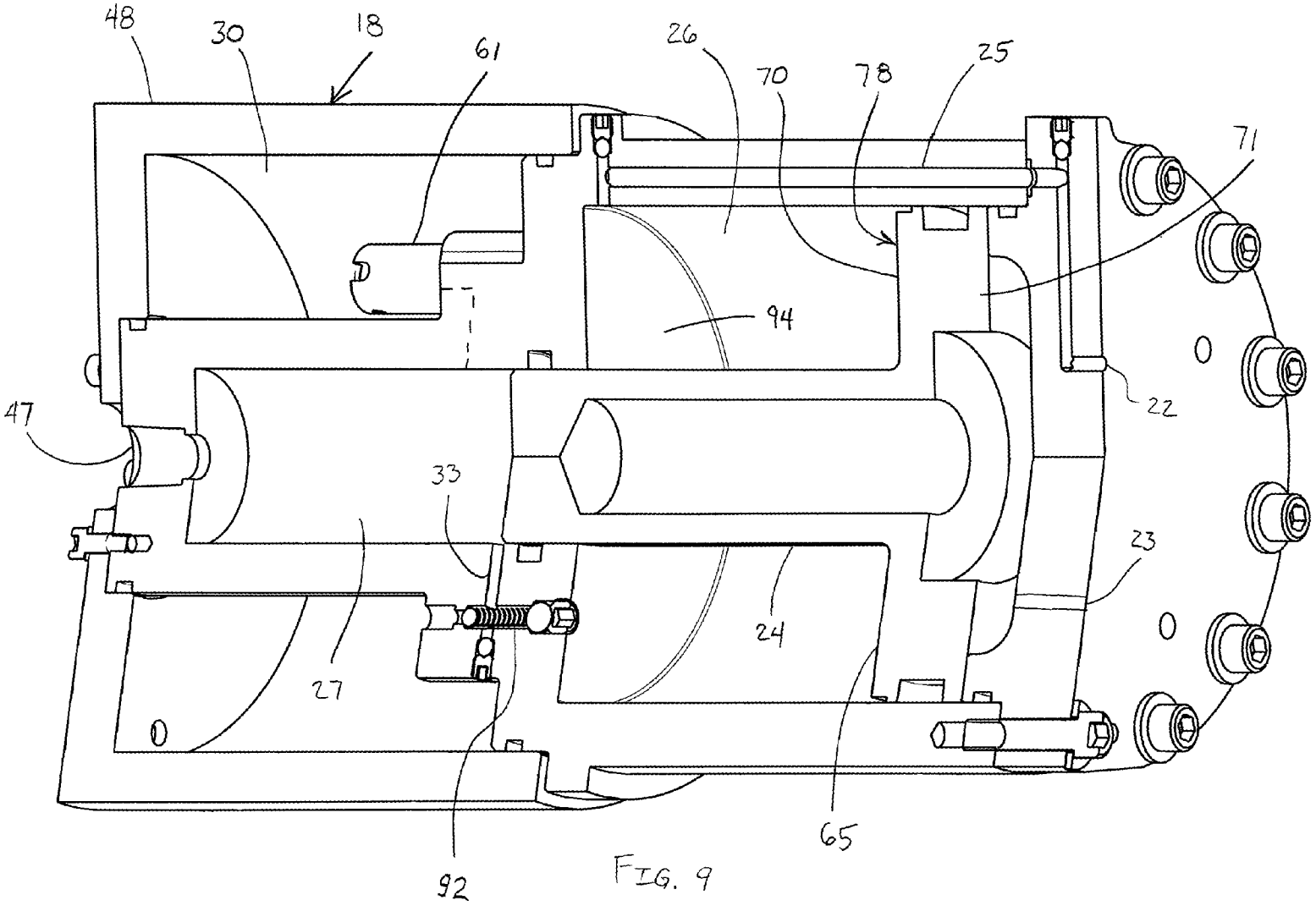
FIG. 9 is a side perspective view in cross-section of the intensifier of FIG. 8.

The intensifier 18, as shown in FIG. 1, has a connection 28 to which a high pressure hose 29 is connected. The high pressure connection 28 is in fluid communication with an opening 47 in a housing 48 of the intensifier 18, as shown in FIG. 9. Operating fluid, such as hydraulic oil, is supplied at a high pressure from a high pressure chamber 27 through the hose 29 to a connection 49 on a tool body 50, as shown in FIG. 1.

Figure 5:
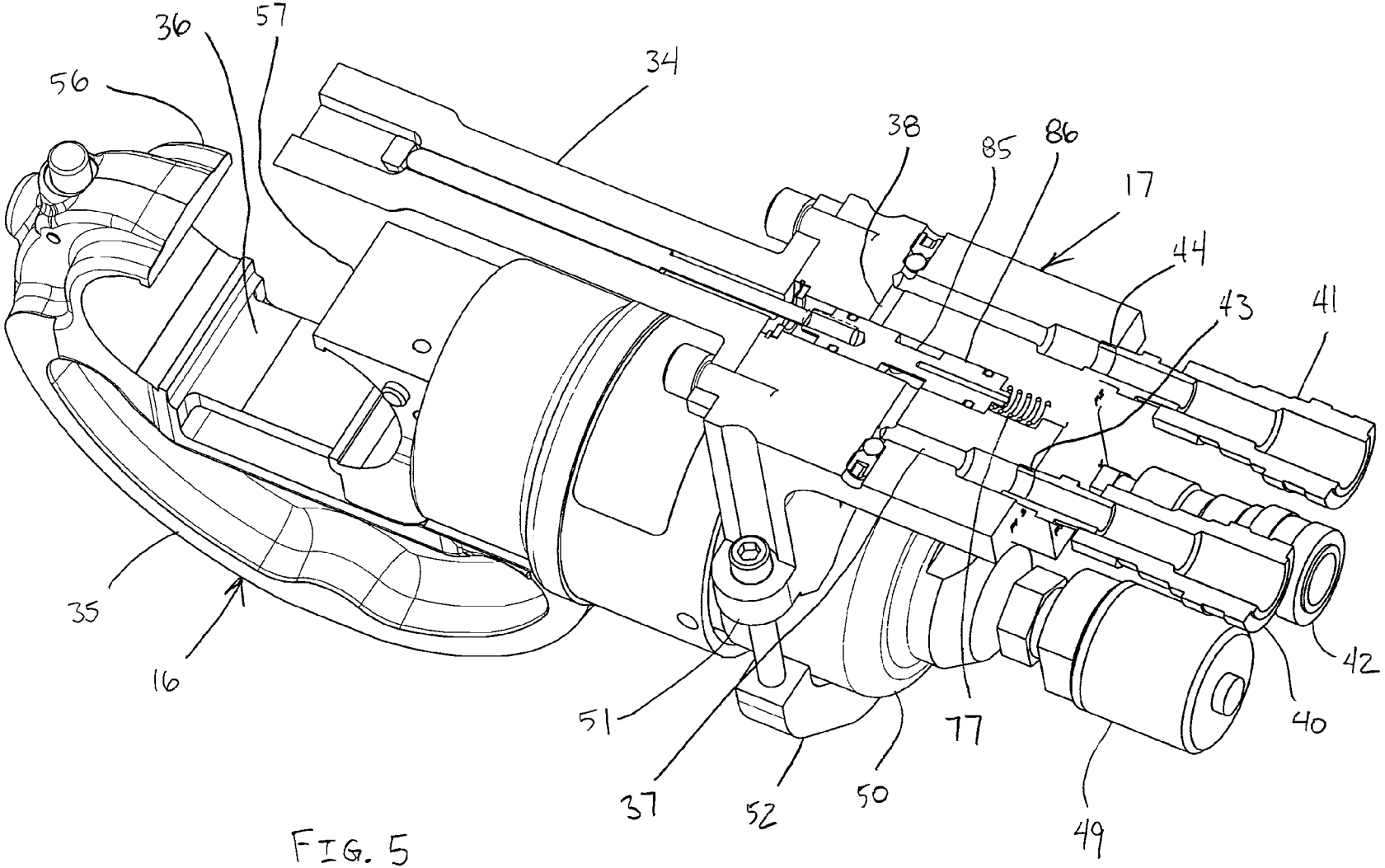
FIG. 5 is an upper perspective view in partial cross section of the hand control valve of FIG. 4 in the second position.

Mounting tabs 51 extend outwardly from opposite sides of the hand control valve housing 46, as shown in FIGS. 3 and 5. A jaw member 52 is connected to the tool body 50. Fasteners 53 are inserted through openings 54 in the mounting tabs 51 and are received by openings 55 in the jaw member 52, thereby securing the hand control valve 17 to the tool 16. The fasteners 53 can be removed from the mounting tabs 51 of the hand control valve housing 46 such that the hand control valve 17 can be easily removed from the tool 16. The hand control valve 17 can then be connected to another tool.

The crimping tool 16 has a fixed crimping member 56 and a movable crimping member 57, as shown in FIG. 3. The movable crimping member 57 is driven through the work area 36 to crimp an object disposed in the work area. The movable crimping member 57 is moved through the work area 36 by a ram (not shown) driven by the high pressure operating fluid, such as hydraulic oil, supplied through the connection 49 from the intensifier 18.

When the trigger 31 of the hand control valve 17 is actuated, a pilot signal (preferably, hydraulic) is sent to a directional control valve 60 in the hydraulic manifold 15 through the third pilot line 39, as shown in FIGS. 10 and 11. The pilot signal moves the directional control valve 60 from a first or retract position 67 to a second or crimping position 66 to direct hydraulic oil to be supplied from the intensifier 18 to the remote crimping tool 16 through the high pressure hose 29 to drive the movable crimping member 57 to perform a crimping operation. The hydraulic oil is supplied to the intensifier 18 through supply hose 21 to drive the ram in a first direction to perform the crimp.

Releasing the trigger 31 of the hand control valve 17 stops the pilot signal being sent to the directional control valve 60 through the third pilot line 39, which turns the directional control valve 60 off by moving the directional control valve to the retract position 67. The supply of operating fluid from the first pilot line 37 is no longer connected to the third pilot line 39 when the trigger 31 is released, such that the third pilot line 39 does not send the operating fluid to the directional control valve 60. A spring member 74 moves the directional control valve 60 to the retract position 67, such that the directional control valve 60 directs the ram of the crimping tool 16 to return to a home position in preparation for the next crimp cycle in response to the signal from the hand control valve 17. The ram is driven in the second direction by supplying oil to a first connection 68 of the intensifier 18 to retract a piston assembly 78 therein, thereby discharging the hydraulic oil from the intensifier 18 through a second connection 69 to a return line 58.

The intensifier 18 is directed by the directional control valve 60 of the hydraulic manifold 15 to perform the desired function, i.e., crimping or retracting the ram to the home position. The directional control valve 60 of the hydraulic manifold 15 is directed by the hand control valve 17 to cause the intensifier to provide the operating fluid pressure for the tool to perform the function (crimping or retracting) selected by the user.

The intensifier 18 increases or intensifies the pressure of supplied hydraulic oil and a hydraulic manifold 15 is connected to the intensifier to control the supply of hydraulic oil thereto. The hydraulic oil is supplied from the intensifier 13, through the hydraulic manifold 15 to the tool 16, such as a crimping or cutting tool. The hand control valve 17 is directly mechanically connected to the tool 16 to control operation of the hydraulic oil supplied to the tool 16.

The intensifier 18 uses low pressure hydraulic oil supplied at approximately 1500 psi and intensifies the pressure to 10,000 psi, thereby obtaining an intensification ratio of approximately six. The low pressure oil is supplied through a supply line 21 from the truck pump 93 to the intensifier 18. The piston assembly 78 movably disposed in the intensifier 18 is preferably unitarily formed as a single member.

Operation and Assembly

The bucket truck valve 32, as shown in FIGS. 10 and 11 is shown in a closed position 62. The activating lever 63 moves the bucket truck valve 32 between closed and open positions 62 and 64. In the closed position 62, the bucket truck valve 32 is closed to prevent the supply of hydraulic oil to the components. In the open position 64, the bucket truck valve 32 supplies oil through supply line 21 to the directional control valve 60 of the hydraulic manifold 15 and the hand control valve 17. Hydraulic oil can also be returned to the truck reservoir 10 from the return line 58 through the bucket truck valve 32. The bucket truck valve 32 is typically kept in the open position 64 when the utility worker is in the bucket truck 12 to facilitate operating the tool 16. The bucket truck valve 32 preferably has a maximum flow rate of approximately 15 gallons per minute (gpm).

When the bucket truck valve 32 is in the first or open position 64, hydraulic oil is supplied to the directional control valve 60 through the supply line 21 and to the hand control valve 17 through the first pilot line 37. The directional control valve 60 is movable between the crimping or second position 66 and a retract or return or first position 67, as shown in FIGS. 10 and 11. The directional control valve 60 is shown in the return position 67. A spring member 74 preferably biases the directional control valve 60 to the return position 67. Hydraulic oil is supplied to the directional control valve 60 through the third pilot line 39 to overcome the spring bias of the spring member 74 to move the directional control valve 60 to the crimping position 66. First and second lines 68 and 69 are connected between the directional control valve 60 of the hydraulic manifold 15 and the intensifier 18. When the directional control valve 60 is in the return position 67, hydraulic oil is supplied through the first line 68 to the rod side of the piston assembly 78. The supplied hydraulic oil pushes against a first surface 70 of the piston assembly 78, thereby moving the piston assembly to the home position (to the right in FIGS. 10 and 11). The hydraulic oil on a second side 71 of the piston assembly 78 is returned through the second line 69, through the directional control valve 60, and through the return line 58 to the truck reservoir 10.

A flow control valve 72 is disposed in the hydraulic manifold and is connected to the supply and return lines 21 and 58 before the directional control valve 60, as shown in FIGS. 10 and 11. The flow control valve 72 is adjustable to control the flow rate of the supplied hydraulic oil to the directional control valve 60. The flow control valve 72 is preferably set to limit the flow rate to approximately 6.0 gpm, which causes to tool 16 to perform a crimp in approximately two seconds. The flow rate can be set higher to provide a quicker crimp, or lower to provide a slower crimp. The hydraulic oil is returned to the truck reservoir 10 through return line 58 from the flow control valve 72 to maintain the set flow rate.

A pressure reducing valve 73 is disposed in the hydraulic manifold 60, as shown in FIGS. 10 and 11, and is connected to the supply and return lines 21 and 58 before the directional control valve 60. The pressure reducing valve 73 limits the pressure of the hydraulic oil supplied therethrough to approximately 1500 psi. The hydraulic oil supplied from the truck reservoir 10 through the bucket truck valve 32 is supplied at a pressure greater than 1500 psi, for example, approximately 2000 psi, to ensure the hydraulic oil supplied to the intensifier is at 1500 psi. Hydraulic oil is returned to the truck reservoir 10 through the return line 58 from the pressure reducing valve 73 to maintain the set pressure.

Figure 6:
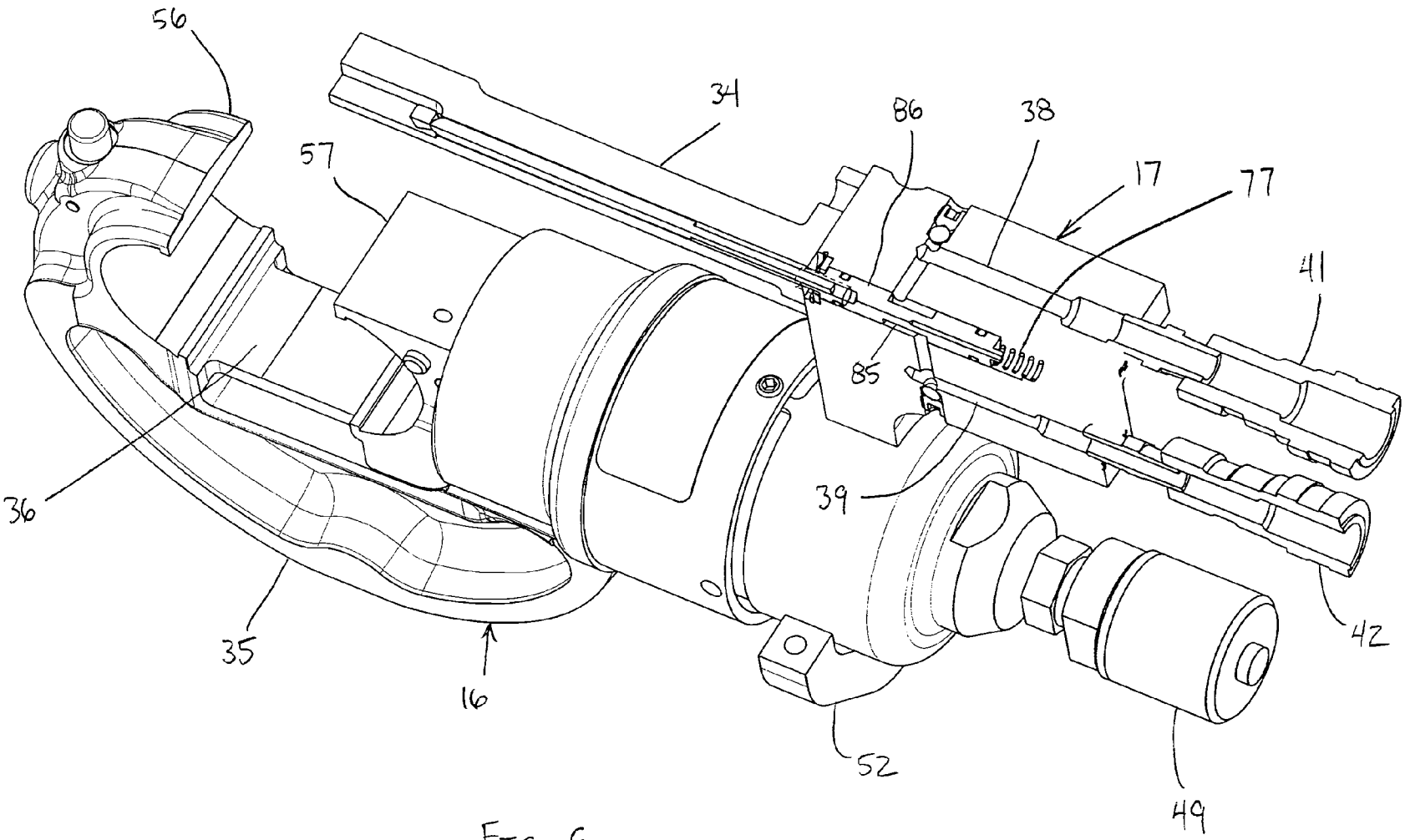
FIG. 6 is a side perspective view in partial cross-section of the hand control valve of FIG. 2 in a first position in which second and third pilot lines are connected.
Figure 7:
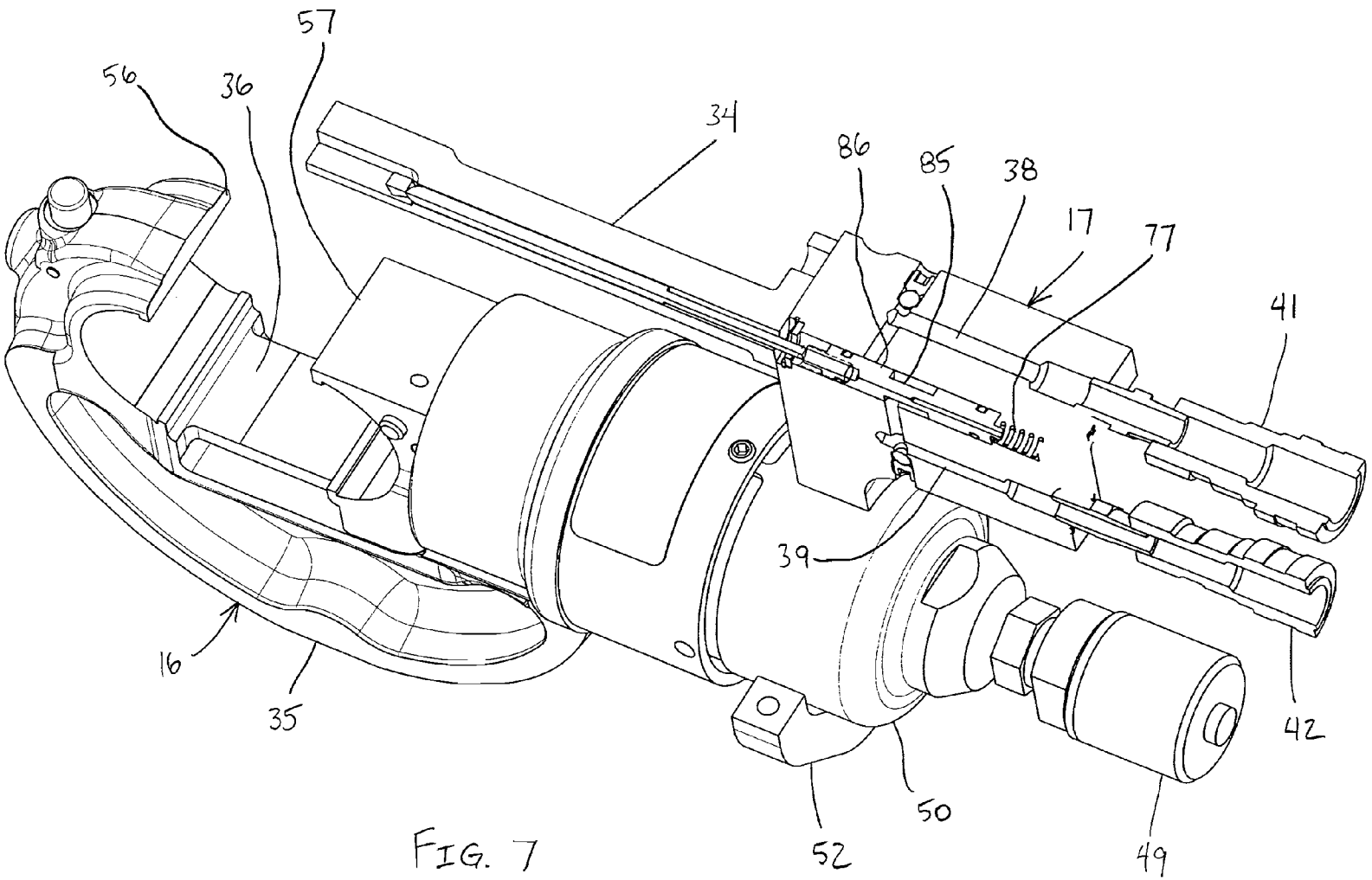
FIG. 7 is a side perspective view in partial cross-section of the hand-control valve of FIG. 2 in the second position in which first and third pilot lines are connected.

Hydraulic oil is supplied to the hand control valve 17 through the first pilot line 37, as shown in FIGS. 10 and 11. The hand control valve 17 is movable between first and second positions 75 and 76, and is shown in the first position 75 in FIGS. 10 and 11. In the first position 75, the second and third pilot lines 38 and 39 are fluidly connected, as shown in FIG. 6, such that hydraulic oil from the supply line 21 through the first pilot line 37 is not supplied to the directional control valve 60. Preferably, a spring member 77 biases the hand control valve 17 to the first position. Activating the trigger 31 of the hand control valve 17 overcomes the spring bias of the spring member 77 and moves the hand control valve 17 to the second position 76, such that the first and third pilot lines 37 and 39 are in fluid communication. The second and third pilot lines 38 and 39 are not connected when the hand control valve 17 is in the second position 76, as shown in FIG. 7. Hydraulic fluid is supplied from the supply line 21, through the first pilot line 37, through the third pilot line 39 to the directional control valve 60 to move the directional control valve to the crimping position 66. Hydraulic oil from the supply line 21 is now supplied through the second line 69 from the directional control valve 60 to the second side 71 of the piston of the intensifier 18. The piston assembly 78 is moved through the intensifier 18 to increase or intensify the pressure of the hydraulic oil in the high pressure cylinder 27 (FIG. 9) to approximately 10,000 psi.

First, second and third ports 82, 83 and 84 in the hydraulic manifold 15 receive the first, second and third pilot connections 40, 41 and 42, respectively. As shown in FIGS, 6, 10 and 11, the directional control valve 60 of the hydraulic manifold 15 is spring-biased to the first position 75 such that the second and third pilot lines 38 and 39 are in fluid communication. A port 85 in a valve member 86 connects the second and third pilot lines 38 and 39. Accordingly, operating fluid is not supplied to the directional control valve 60 such that the directional control valve is in the retract position 67 because the first pilot line 37 is not connected to the third pilot line 39.

Figure 4:
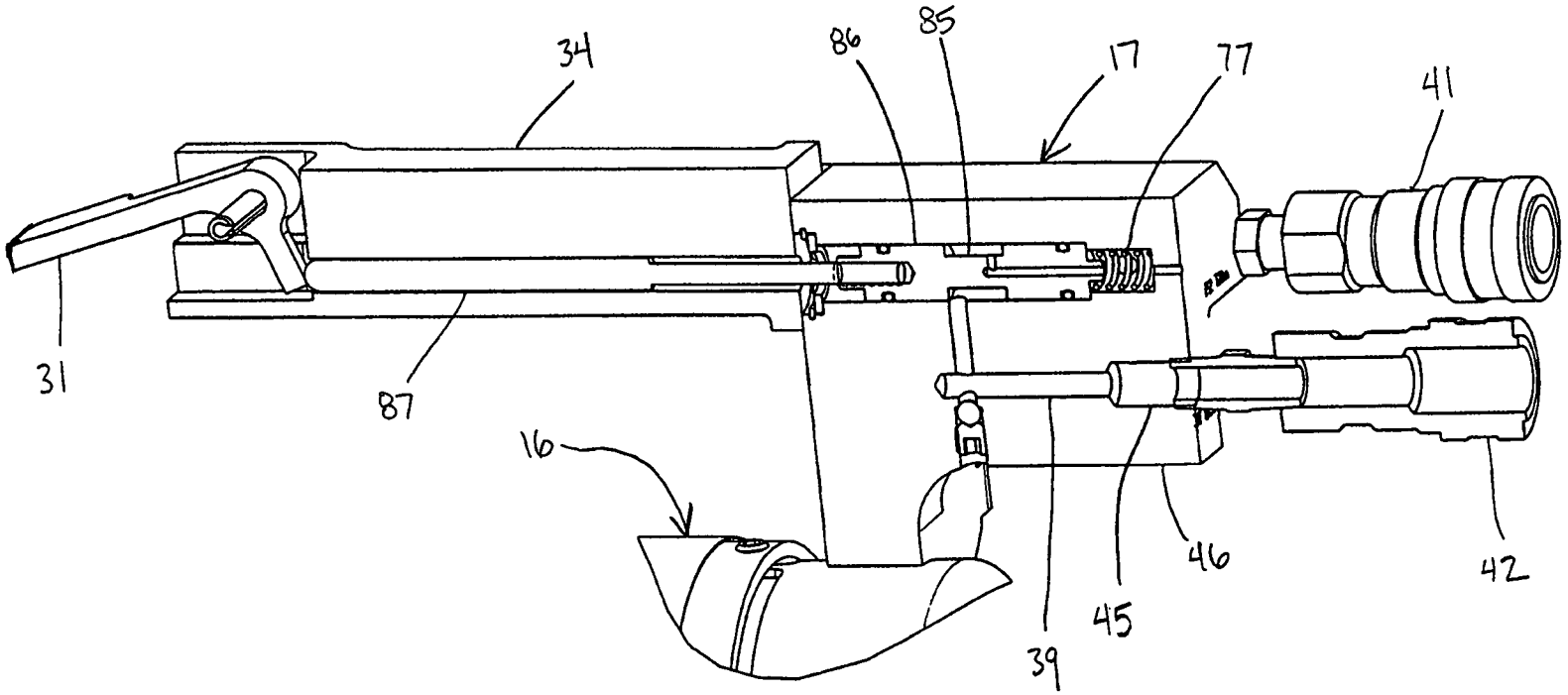
FIG. 4 is a side perspective view in partial cross-section of the hand control valve of FIG. 2 in a second position in which first and third pilot lines are connected.

Activating the trigger 31 of the hand control valve 17 moves the valve member 86 to overcome the spring bias of the spring member 77, such that the port 85 connects the first and third pilot lines 37 and 39, as shown in FIGS. 4, 5 and 7. A rod 87 extends between the trigger 31 and the valve member 86 to move the valve member responsive to activating the trigger 31. Operating fluid from the truck pump 93 can be supplied from the supply line 21, through the first pilot line 37 and through the third pilot line 39 to the directional control valve 60 to move the directional control valve to the crimping position 66. The second and third pilot lines 38 and 39 are not connected when the trigger 31 of the hand control valve 17 is operated. Releasing the trigger 31 causes the spring member 77 to move the valve member 86 to the first position 75 (FIGS. 10 and 11) in which the second and third pilot lines 38 and 39 are connected.

To achieve intensification, hydraulic oil is supplied to the second side 71 of the large diameter (e.g., 5.68 inch diameter), low pressure flange 65 of the piston assembly 78 disposed in the intensifier 18 through a crimping inlet port 23, as shown in FIG. 9. The hydraulic oil is supplied through the supply line 21 to the directional control valve 60, which supplies the oil to the crimping inlet port 23 of the intensifier 18 when the directional control valve is in the crimping position 66 (FIGS. 10 and 11). The high pressure piston rod 24 is of a smaller diameter (e.g., 2.00 inch diameter). The high pressure piston rod 24 is sized to allow approximately 300 psi back pressure on the first side 70 of the large piston flange 65. There is also hydraulic oil in a low pressure cylinder 26 of the intensifier 18. Movement of the piston assembly 78 through the intensifier 18 during a crimping procedure pushes the oil on the first side 70 of the piston flange 65 out through conduit 25, through outlet 22, through the first line 68, through the directional control valve 60 and back to the truck reservoir 10 through the return line 58. A check valve 79 can be disposed in the return line 58 to prevent oil flow through the directional control valve 60 to the second line 69 to the intensifier 18 when the directional control valve 60 is in the return position 67. When backpressure is too high or a restriction occurs in the return line 58 to the truck reservoir 10, the check valve 79 substantially prevents oil flow through the second line 69 to the second side 71 of the piston assembly 78 in the intensifier 18. A check valve 81 can be connected between the supply and return lines 21 and 58 and to the third pilot line 39 to facilitate shifting of the directional control valve 60.

To perform the crimping cycle, the user activates the trigger 31 of the hand control valve 17. Hydraulic oil is directed to the hydraulic manifold 15, which redirects oil to the large diameter piston 65 of the intensifier, which starts the crimp cycle. Hydraulic oil at 1500 psi acts on the second side 71 of the piston flange 65 and applies a high force onto the small diameter piston rod 24. The small diameter piston rod then compresses the hydraulic oil in the small cylinder 27 to approximately 10,000 psi. The intensified high pressure oil is forced out of the intensifier 18 through a high pressure hose 29 connected to a high pressure outlet 28, which is connected to the remote crimp tool 16. The remote crimp tool 16 is designed to make a good crimp at 10,000 psi operating pressure. When the recommended pressure of 10,000 psi is reached, a pressure relief valve 61 opens to relieve the pressure back to an intensifier reservoir 30, as shown in FIG. 9. The intensifier reservoir 30 is preferably made of a flexible material. The intensified high pressure oil is forced out of the intensifier 18 through a high pressure hose 29 having a connector 49 connected to a high pressure outlet 47, which is connected to the remote crimp tool 16.

The intensifier reservoir 30 is isolated from the truck reservoir 10 in the truck. The crimp cycle is complete when the pressure relief valve 61 opens. When the pressure relief valve 61 opens, an audible pop is detected, and the 10,000 psi hose 29 connected coupled to the remote crimp tool 16 flexes as pressure is quickly released. The audible pop of the pressure relieve valve 61 and the flex of the hydraulic hose 29 are indications to the operator that the crimp cycle is complete. Additionally, the large piston 65 in the intensifier 18 bottoms against a lower surface 94 of the cylinder 26 and the thump noise is heard.

As a result, the operator releases the activate trigger 31 on the hand control valve 17 and oil is no longer directed to the hydraulic manifold 15 from the hand control valve, thereby redirecting oil to the rod side on the first side 70 of the piston flange 65 from the supply line 21. The spring member 77 moves the hand control valve 17 to the first position 75, such that the first and second pilot lines 37 and 39 are no longer connected. The spring member 74 of the directional control valve 60 then biases the directional control valve 60 to the retract position 67. The shift of the directional control valve 60 causes the hydraulic oil supplied to the directional control valve 60 to be directed through the first line 68 to the connection port 22 in the intensifier and through conduit 25 to the low pressure cylinder 26 on the first side 70 of the piston flange 65. Accordingly, the piston assembly 78 retracts to the home position, as shown in FIG. 9. During this retraction phase, oil is pulled in through a check valve 92 allowing the high pressure cylinder 27 to reload oil from the intensifier reservoir 30 through a conduit 33 in preparation for the next crimp cycle.

The intensifier 18 is powered by a bucket truck circuit 32 and provides intensified oil that is directed through the high pressure hydraulic hose 29 to the crimping tool 16. Intensification of the oil is performed with a single stroke motion of the piston assembly 78 within the intensifier 18. The oil delivery to the crimping tool 16 is pressure limited to approximately 10,000 psi by the pressure relief valve 61 within the intensifier 18. This intensifier 18 causes the tool 16 to perform a full crimp in approximately two seconds because it displaces a large amount of hydraulic oil in a single stroke motion. The intensifier 18 also has few moving parts, thereby simplifying assembly and operation thereof. The pressure relief valve 61 within the high pressure cylinder 27 of the intensifier 18 opens to relieve pressure when a predetermined pressure value (10,000 psi) is reached for a good crimp.

When the pressure relief valve 61 opens, a large amount of oil from the high pressure cylinder 27 and the tool 16 is relieved into the intensifier's reservoir 30. The high pressure relief valve 61 stays open until the piston flange 65 reaches the bottom of its stroke. At an end of the stroke, the relief valve 61 closes. When the user releases the hand control valve lever 31, the intensifier 18 enters retraction mode. As the piston rod 24 retracts, a check valve 32 within the high pressure cylinder 27 is forced open, allowing the high pressure cylinder 27 to fill with oil from the intensifier reservoir 30. Thus, the hydraulic oil in the intensifier reservoir 30 and the tool 16 is isolated from the truck oil and is therefore less susceptible to contamination.

The intensifier 18 is operator controlled by the low pressure hand control valve 17, which is held in the palm of the user's hand and allows activation with the push of the lever 31 and retraction with the release of the lever 31. The hand control valve 17 provides the handle 34 that shifts the center of gravity of the crimping tool 16 and hand control valve 17 to a more ergonomic position, thereby reducing operator strain. There are no high pressure components held in the user's hand. The hand control valve 17 is modular and can be removed by the user for crimp and cut tool swap out. The protective shield 59 (FIG. 3) covers the low pressure hydraulic couplings (40, 41 and 42) to protect them from damage.

The hydraulic manifold 15 allows the user to operate the intensifier 18 in crimping and retract positions 66 and 67. When the directional control valve 60 of the hydraulic manifold 15 is in the retract position 67, the piston assembly 78 of the intensifier 18 returns to the home position in preparation for the next crimp cycle.

Although described with regard to the crimping tool 16, the present invention is also applicable to other hydraulically operated tools, such as a cutting tool. As shown in FIG. 11, an additional tool 91 can be connected to the bucket truck valve 32 to be operated thereby. Preferably, a three position bucket truck valve 32 is used, as shown in FIG. 11. A return line 95 from the additional tool 91 can be directed to the truck reservoir 10.

The foregoing embodiment and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A high pressure tool assembly, comprising:

a tool including a tool head;

a hand control valve connected to said tool and including a handle spaced away from said tool head;

a hydraulic manifold fluidly connected to said hand control valve;

an intensifier fluidly connected to said hydraulic manifold and to said tool, said intensifier increasing a pressure of a first operating fluid supplied to said tool;

a first fluid circuit formed between said hand control valve, said hydraulic manifold and said intensifier, said first fluid circuit operating at a first pressure; and a second fluid circuit formed between said intensifier and the tool, said second fluid circuit operating at a second pressure, said second pressure being larger than said first pressure and said second fluid circuit being isolated from said first fluid circuit, whereby a user operating said tool assemble grips said handle having only said first pressure fluid passing therethrough.

2. The high pressure tool assembly according to claim 1, wherein said hand control valve is removably connected to said tool.

3. The high pressure tool assembly according to claim 1, wherein said handle of said hand control valve is disposed proximal the center of gravity of said tool to facilitate handling said tool with said handle of said hand control valve.

4. The high pressure tool assembly according to claim 1, wherein a flow control valve disposed in said hydraulic manifold limits a flow rate of a second operating fluid supplied to said intensifier.

5. The high pressure tool assembly according to claim 4, wherein said flow control valve is adjustable to control the flow rate of the second operating fluid supplied to the intensifier.

6. The high pressure tool assembly according to claim 1, wherein a pressure reducing valve disposed in said hydraulic manifold limits a pressure of a second operating fluid supplied to said intensifier.

7. The high pressure tool assembly according to claim 6, wherein said pressure reducing valve is adjustable to control the pressure of the second operating fluid supplied to said intensifier.

8. The high pressure tool assembly according to claim 1, wherein a directional control valve disposed in said hydraulic manifold supplies a second operating fluid to a first connection of said intensifier when said hand control valve is in a first position.

9. The high pressure tool assembly according to claim 8, wherein said directional control valve supplies the second operating fluid to a second connection of said intensifier when said hand control valve is in a second position.

10. The high pressure tool assembly according to claim 9, wherein said directional control valve moves from a retract position to a crimping position responsive to a signal received from said hand control valve.

11. The high pressure tool assembly according to claim 10, wherein a spring member returns said directional control valve from said crimping position to said retract position when said hand control valve stops sending said signal to said directional control valve.

12. The high pressure tool assembly according to claim 1, wherein said hydraulic manifold is directly mechanically connected to said intensifier.

13. The high pressure tool assembly according to claim 1, wherein said hydraulic manifold is remote from said hand control valve.

14. A method of operating a high pressure tool, comprising the steps of gripping a handle of said high pressure tool having a hand control valve;

sending a signal from the hand control valve spaced away from a tool head to a hydraulic manifold;

supplying a first operating fluid from the hydraulic manifold to a first connection of an intensifier responsive to the received signal;

pressurizing a second operating fluid to a high pressure with a piston assembly of the intensifier responsive to the first operating fluid received by the first connection of the intensifier; and supplying the high pressure second operating fluid to the tool head.

15. The method of operating a high pressure tool according to claim 14, further comprising stopping the signal from the hand control valve to the hydraulic manifold; and supplying the first operating fluid from the hydraulic manifold to a second connection of the intensifier responsive to the received signal to return the piston assembly to a home position.

16. The method of operating a high pressure tool according to claim 14, wherein the first operating fluid is isolated from the second operating fluid.

17. The method of operating a high pressure tool according to claim 16, further comprising moving a directional control valve of the hydraulic manifold between first and second positions to control the supply of the operating fluid to the first and second connections of the intensifier.

18. The method of operating a high pressure tool according to claim 14, further comprising controlling a flow rate of the first operating fluid supplied to the first connection of the intensifier with a flow control valve.

19. The method of operating a high pressure tool according to claim 14, further comprising controlling a pressure of the first operating fluid supplied to the first connection of the intensifier with a pressure reducing valve.

20. The method of operating a high pressure tool according to claim 17, further comprising facilitating movement of the directional control valve of the hydraulic manifold with a check valve.

* * * * *